US005319855A

United States Patent [19]

Beevers et al.

[11] Patent Number: 5,319,855

[45] Date of Patent: Jun. 14, 1994

[54] MINERAL CUTTER TIP AND PICK

[75] Inventors: Charles M. Beevers; William S. Clapham, both of Ecclesfield, England

[73] Assignee: Hydra Tools International PLC, Sheffield, England

[21] Appl. No.: 977,527

[22] Filed: Nov. 17, 1992

[30] Foreign Application Priority Data

Nov. 30, 1991 [GB] United Kingdom ..... 9125536

[51] Int. Cl.[5] ..... E21B 10/00

[52] U.S. Cl. ..... 30/308.1; 299/79

[58] Field of Search ..... 30/308.1, 357, 41.7, 30/348, 346.6; 125/42, 43, 40; 299/79, 91; 175/39, 427; 409/134, 148; 76/DIG. 11, DIG. 12; 407/119, 113

[56] References Cited

U.S. PATENT DOCUMENTS

| | | | |
|---|---|---|---|
| 1,081,131 | 12/1913 | Moore | 299/79 |
| 1,927,818 | 9/1933 | Brodersen | 299/91 |
| 2,828,117 | 3/1958 | Bruestle et al. | 299/79 |
| 4,674,802 | 6/1987 | McKenna et al. | 175/427 |
| 4,725,098 | 2/1988 | Beach | 299/79 |

FOREIGN PATENT DOCUMENTS

| | | | |
|---|---|---|---|
| 12909526 | 1/1966 | Fed. Rep. of Germany | 299/79 |
| 971838 | 10/1964 | United Kingdom | 299/79 |
| 1184794 | 3/1970 | United Kingdom | 299/79 |

*Primary Examiner*—Richard K. Seidel
*Assistant Examiner*—Hwei-Siu Payer
*Attorney, Agent, or Firm*—Trexler, Bushnell, Giangiorgi & Blackstone, Ltd.

[57] ABSTRACT

A tip (1A, 1B, 1C, or 1D) of hard material has in at least one external surface, a wear line or marker (12) in the form of a rib (13, 16 or 17), or a groove (15) capable of being felt by a thumb or finger of a miner, so that a visual inspection for wear is unnecessary. The invention also includes a pick (5) provided with such a tip.

2 Claims, 1 Drawing Sheet

MINERAL CUTTER TIP AND PICK

Figure 1:
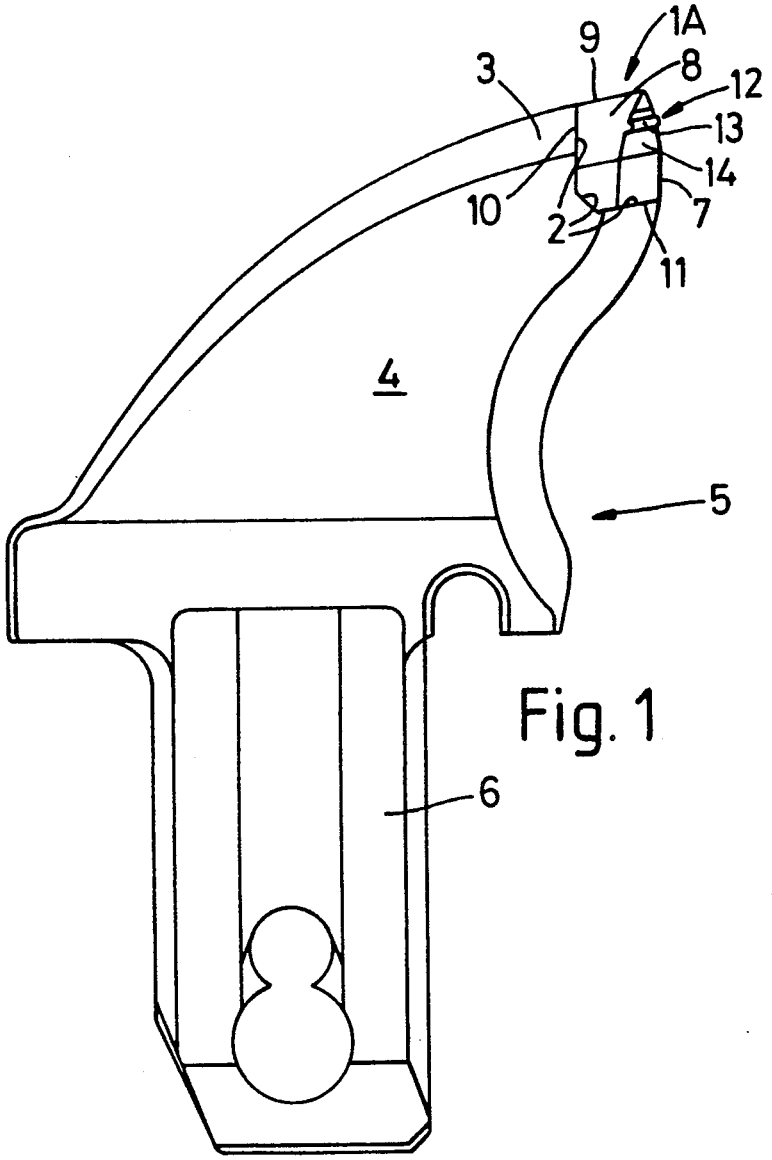

This invention relates to a mineral cutter tip and pick.

Conventionally, picks are forged with an integral head and shank from steel, typically EN 19, and a tip receiving seat is machined into the head to receive a tip of hard material, e.g. tungsten carbide, which is brazed in position.

In the mining of coal avoidance of steel-to-rock/coal contact is desirable to lessen the prospect of spontaneous combustion in the so-called incendive sparking zone behind a tip/pick head, having regard to the cutting direction in which the pick is driven, in use. Although pick inspection and replacement is routine, it is frequently difficult in mine conditions to establish just how much tip wear has occurred and hence whether pick replacement is desirable.

The invention will assist in solving this problem.

According to a first aspect of the present invention, there is provided a tip of hard material having in at least one external surface, a wear line or marker.

According to a second aspect of the present invention, there is provided a mineral cutter pick of the radial, forward attack, or semi-forward attack type, provided with a tip as defined above.

Thus, with the tip and pick in accordance with the invention, all guesswork and/or personal judgement as to the amount of wear that has accrued is removed, as the miner has in the form of the wear line or marker a positive aid for decisions re pick changing.

MINERAL CUTTER TIP AND PICK

This invention relates to a mineral cutter tip and pick.

Conventionally, picks are forged with an integral head and shank from steel, typically EN 19, and a tip receiving seat is machined into the head to receive a tip of hard material, e.g. tungsten carbide, which is brazed in position.

In the mining of coal avoidance of steel-to-rock/coal contact is desirable to lessen the prospect of spontaneous combustion in the so-called incendive sparking zone behind a tip/pick head, having regard to the cutting direction in which the pick is driven, in use. Although pick inspection and replacement is routine, it is frequently difficult in mine conditions to establish just how much tip wear has occurred and hence whether pick replacement is desirable.

The invention will assist in solving this problem.

According to a first aspect of the present invention, there is provided a tip of hard material having in at least one external surface, a wear line or marker.

According to a second aspect of the present invention, there is provided a mineral cutter pick of the radial, forward attack, or semi-forward attack type, provided with a tip as defined above.

Thus, with the tip and pick in accordance with the invention, all guesswork and/or personal judgement as to the amount of wear that has accrued is removed, as the miner has in the form of the wear line or marker a positive aid for decisions re pick changing.

Although the wear line or marker could take the form of a groove, this could lead to the propogation of fissures or cracks in service, and accordingly in accordance with a preferred feature, the wear line is constituted by a rib, e.g. of semi-circular section. Consequently, such a marker need not necessarily be visible, for with a remotely located pick, the miner may simply feel with a finger whether the rib is still present.

The wear line or marker is preferably formed in a front face of the tip, but additionally, may be formed in, or extend into, one and preferably both side faces of the tip, which faces are, conventionally, inclined to a common, leading edge. The wear line(s) or markers can be readily formed in the tip during pressing and sintering, simply by modifying the dies. Consequently, all industry-standard tip shapes can be produced with a wear line or marker.

Figure 2:
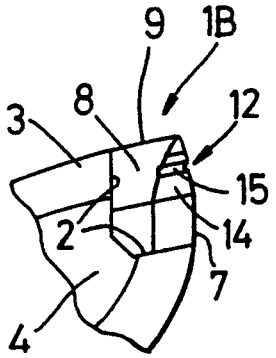
Figure 3:
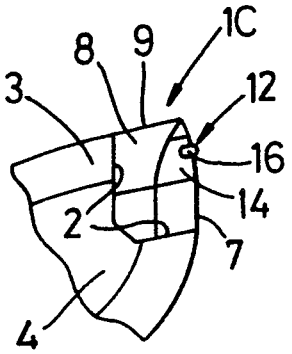
Figure 4:
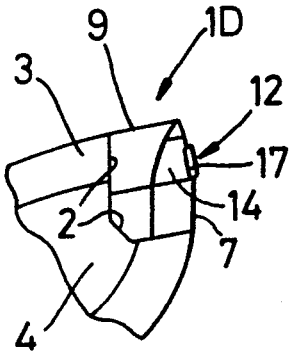

The invention will now be described in greater detail by way of example, with reference to the accompanying drawings, in which:

FIG. 1 is a side elevation of an industry standard pick provided with a first embodiment of tip; and FIGS. 2, 3 and 4 correspond to FIG. 1 but show only a portion of pick head, with second, third and fourth embodiments of tip.

In the drawings a hard material tip 1A, 1B, 1C and 1D e.g. of tungsten carbide, is secured by brazing into a receiving notch 2 machined into the leading end 3 of the head 4 of a mineral cutter pick 5 of steel having a shank 6 by which the pick 5 is releasably retained in a receiving aperture in a pick box (not shown).

Various industry-standard tips exist all usually having a front edge 7, side faces 8, a top face 9 and seating faces 10, 11.

In accordance with the invention, the extent of wear of tips 1A, 1B, 1C abd 1D is readily determined in situ, in mine conditions, not by the miner needing to visually inspect a tip—usually by removing the pick from its pick box—but simply by feeling for a wear line or marker 12, even if the pick 5 is in a location on a rotary cutting head that is not readily accessible.

This positive identification of the wear that has taken place not only ensures that, from the safety view point, picks are changed in good time, but from the economic viewpoint that unnecessary pick changes are avoided.

In the embodiment of FIG. 1, the wear line or marker 12 takes the form of a rib 13, of semi-circular section, formed on mutually inclined side face portions 14 leading to, and terminating at, the front edge 7.

In the embodiment of FIG. 2, the wear line or marker 12 extends in the same direction as that of FIG. 1, i.e. converges to the front edge 7, but is formed as a groove 15.

In the embodiment of FIG. 3, the wear line or marker 12 takes the form of a rib or button 16 of semi-circular section wrapped around the front edge 7 for a short distance along the converging side face portions 14.

Finally, in the embodiment of FIG. 4, the wear line or marker 12 is again in the form of a rib 17 of semi-circular section but extends in this embodiment along the front edge 7.

What we claim is:

1. A mineral cutter tip of hard material having a front leading edge and side faces, wherein a single, clearly defined wear marker line in the form of a projecting rib extends at least at said front leading edge, wherein said tip is of tungsten carbide and said wear marker is formed in said tip during pressing and sintering.

2. A mineral cutter pick provided with a tip of hard material, having a front leading edge and side faces, wherein a single, clearly defined wear marker line in the form of a projecting rib extends at least at said front leading edge, and wherein said tip is of tungsten carbide and said wear marker is formed in said tip during pressing and sintering.

* * * * *